US005764559A

United States Patent [19]

Kimura

[11] Patent Number: 5,764,559

[45] Date of Patent: Jun. 9, 1998

[54] BIPOLAR MULTIPLIER HAVING WIDER INPUT VOLTAGE RANGE

[75] Inventor: Katsuji Kimura, Tokyo, Japan

[73] Assignee: NEC Corporation, Tokyo, Japan

[21] Appl. No.: 651,869

[22] Filed: May 21, 1996

[30] Foreign Application Priority Data

May 22, 1995 [JP] Japan ..... 7-122185

[51] Int. Cl.[6] ..... G06G 7/16

[52] U.S. Cl. ..... 364/841; 327/359

[58] Field of Search ..... 327/355, 357, 327/359; 364/841

[56] References Cited

U.S. PATENT DOCUMENTS

| | | |
|---|---|---|
| 5,107,150 | 4/1992 | Kimura . |
| 5,187,682 | 2/1993 | Kimura . |
| 5,438,296 | 8/1995 | Kimura . |
| 5,523,717 | 6/1996 | Kimura . |
| 5,552,734 | 9/1996 | Kimura . |
| 5,578,965 | 11/1996 | Kimura . |
| 5,581,210 | 12/1996 | Kimura . |

FOREIGN PATENT DOCUMENTS 2 290 398 12/1995 United Kingdom .

OTHER PUBLICATIONS

Barrie Gilbert, "A Precise Four–Quadrant Multiplier with Subnanosecond Response", *IEEE Journal of Solid–State Circuits*, vol. SC–3, No. 4, Dec. 1968, pp. 365–373.

Katsuji Kimura, "A Unified Analysis of Four–Quadrant Analog Multipliers Consisting of Emitter and Source–Coupled Transistors Operable on Low Supply Voltage", *IEICE Trans. Electron.*, vol. E–76–C, No. 5, May 1993, pp. 714–737.

*Primary Examiner*—Tan V. Mai

*Attorney, Agent, or Firm*—Sughrue, Mion, Zinn, Macpeak & Seas, PLLC

[57] ABSTRACT

In a bipolar multiplier for multiplying a first input signal and a second input signal, the bipolar multiplier comprises a quadritail cell including two transistor pairs driven by a common tail current. A conversion circuit is connected to an input side of the quadritail cell for carrying out inverse hyperbolic tangent conversion. The conversion circuit comprises first and second differential amplifiers which are supplied with the first and the second input signals, respectively.

6 Claims, 3 Drawing Sheets

BIPOLAR MULTIPLIER HAVING WIDER INPUT VOLTAGE RANGE

BACKGROUND OF THE INVENTION

This invention relates to a multiplier for multiplying two analog signals and, in particular, to a linearized multiplier formed on a bipolar semiconductor integrated circuit.

A conventional bipolar multiplier of the type described is proposed by the present applicant and contributed to IEICE TRANS. ELECTRON. VOL. E76-C. pages, 714 to 737, No. 5 MAY 1993, under the title of "A Unified Analysis of Four-Quadrant Analog Multipliers Consisting of Emitter and Source-coupled Transistors Operable on Low Supply Voltage". A linearized bipolar multiplier of the type is well known as a Gilbert multiplier since it was disclosed in 1968.

In analog signal processing operations, the multiplier is an essential functional block. As the fabrication process becomes finer, a supply voltage for an LSI is reduced down to a level between 5 (V) and 3 (V) or a lower level. A demand for a circuit operable at a low supply voltage is more and more increasing. Although the conventional multiplier is operable at a low supply voltage, an input voltage range is very narrow as a linear input voltage range.

SUMMARY OF THE INVENTION

It is therefore an object of this invention to provide a bipolar multiplier having an input voltage range wider than that of a conventional bipolar multiplier.

It is another object of this invention to provide the bipolar multiplier which is operable at a low supply voltage as low as 2 (V).

A bipolar multiplier according to this invention is for multiplying a first input signal and a second input signal. The bipolar multiplier comprises a quadritail cell including two transistor pairs driven by a common tail current and composed of first through fourth transistors whose outputs are connected in common to form differential output pairs. The bipolar multiplier further comprises a conversion circuit connected to an input side of the quadritail cell for carrying out inverse hyperbolic tangent conversion and composed of first and second differential amplifiers which are supplied with the first and the second input signals, respectively.

DESCRIPTION OF THE PREFERRED EMBODIMENT

Figure 1:
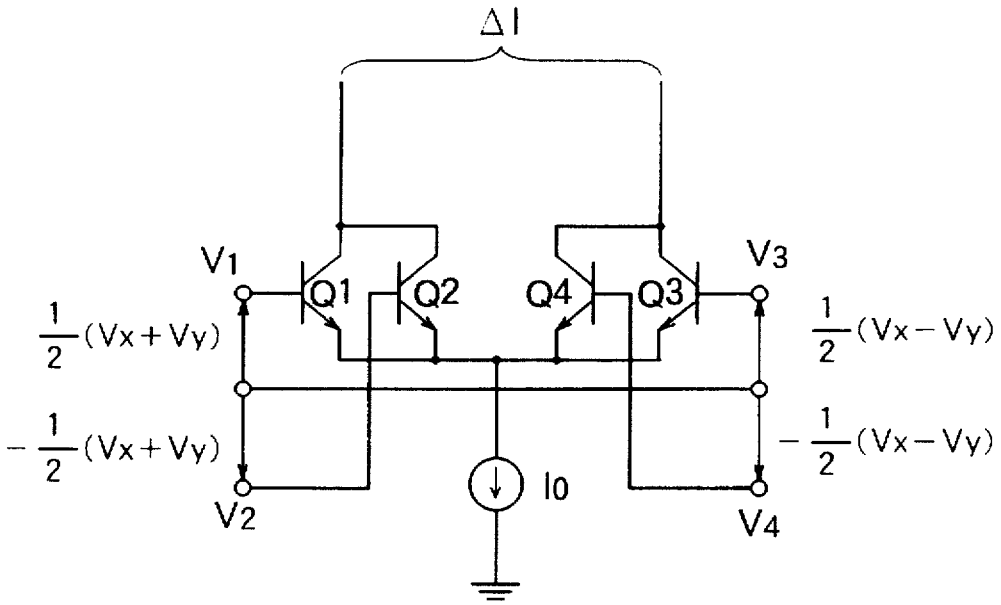
FIG. 1 PRIOR ART
FIG. 1 shows a circuit diagram of a conventional bipolar multiplier.

Referring to FIG. 1, a conventional bipolar multiplier will be described at first in order to facilitate an understanding of the present invention. In the following description, a circuit comprising three or more transistors driven by a single common tail current is referred to as a multitail cell. Specifically, the circuit comprising four transistors is referred to as a quadritail cell.

In FIG. 1, the bipolar multiplier comprises a quadritail cell comprising first through fourth transistors Q1, Q2, Q3, and Q4. Each of a combination of the first and the second transistors Q1 and Q2 and a combination of the third and the fourth transistors Q3 and Q4 may collectively be called a transistor pair. The transistor pairs are driven by a common tail current $I_O$.

In a transistor, it is assumed that the relationship between a collector current $I_{Ci}$ and a base-to-emitter voltage $V_{BEi}$ follows an exponential law. In this event, the relationship is represented by:

$$I_{Ci} = I_S\left\{ \exp\left(\frac{V_{BEi}}{V_T}\right) - 1 \right\}. \tag{1}$$

Herein, $I_S$ represents the saturation current and $V_T$ represents the thermal voltage defined by $V_T$=kT/q, where q represents the charge of an electron, k, the Boltzmann's constant, T, absolute temperature.

In Equation (1), the exponential part "exp ($V_{BEi}/V_T$)" is equal to a value on the order of the tenth power [$10^{10}$] when the transistor having the base-to-emitter voltage $V_{BEi}$ on the order of 600 mV is normally operated. In this event, the term "−1" can be neglected. Accordingly, the equation (1) is approximated as:

$$I_{Ci} = I_S\exp\left(\frac{V_{BEi}}{V_T}\right) \tag{2}$$

Assuming matched devices, collector currents $I_{C1}$–$I_{C4}$ of the transistors Q1–Q4 driven by the tail current $I_{EB}$ are given by:

$$I_{C1} = I_S\exp\left(\frac{V_1 + V_R - V_E}{V_T}\right), \tag{3}$$

$$I_{C2} = I_S\exp\left(\frac{V_2 + V_R - V_E}{V_T}\right), \tag{4}$$

$$I_{C3} = I_S\exp\left(\frac{V_3 + V_R - V_E}{V_T}\right), \tag{5}$$

and $$I_{C4} = I_S\exp\left(\frac{V_4 + V_R - V_E}{V_T}\right), \tag{6}$$

where $V_R$ represents a dc voltage of an input signal, $V_E$, a common emitter voltage. From the condition for the tail current, the following equation holds:

$$I_{C1}+I_{C2}+I_{C3}+I_{C4}=\alpha_F I_O, \tag{7}$$

where $\alpha_F$ represents a dc amplification factor of the transistor. Solving Equation (7) with Equations (3) through (6), the following equation is given:

$$I_S\exp\left(\frac{V_R - V_E}{V_T}\right) = \frac{\alpha_F I_0}{\exp\left(\frac{V_1}{V_T}\right) + \exp\left(\frac{V_2}{V_T}\right) + \exp\left(\frac{V_3}{V_T}\right) + \exp\left(\frac{V_4}{V_T}\right)}. \tag{8}$$

A differential output current ΔI of the bipolar quadritail cell is represented by:

$$\Delta I = (I_{C1} + I_{C2}) - (I_{C3} + I_{C4}) = \tag{9}$$

-continued $$\frac{\alpha_F I_0 \left\{ \exp\left(\frac{V_1}{V_T}\right) + \exp\left(\frac{V_2}{V_T}\right) - \exp\left(\frac{V_3}{V_T}\right) - \exp\left(\frac{V_4}{V_T}\right) \right\}}{\exp\left(\frac{V_1}{V_T}\right) + \exp\left(\frac{V_2}{V_T}\right) + \exp\left(\frac{V_3}{V_T}\right) + \exp\left(\frac{V_4}{V_T}\right)}.$$

In the bipolar multiplier illustrated in FIG. 1, the following equations hold:

$$V_1 = (Vx + Vy)/2;$$
$$V_2 = -(Vx + Vy)/2$$
$$V_3 = (Vx - Vy)/2;$$
and $$V_4 = -(Vx - Vy)/2;$$

Substituting these equations into Equation (9), the differential output current ΔI of the bipolar multiplier is represented by:

$$\Delta I = \alpha_F I_0 \tanh\left(\frac{Vx}{2V_T}\right) \tanh\left(\frac{Vy}{2V_T}\right). \quad (10)$$

Multiplying the right side of Equation (10) by $\alpha_F$, a well-known double-balanced differential amplifier called a Gilbert multiplier cell or Gilbert cell is obtained. In a typical bipolar process, $\alpha_F$ has a value between 0.98 and 0.99 and is substantially equal to 1. Accordingly, the bipolar multiplier using the conventional quadritail cell has a transfer characteristic substantially identical to that of the Gilbert multiplier cell but is operable at a low supply voltage because the transistors are not laid in series. However, the transfer characteristic represented by Equation (10) has a poor linearity to an input voltage, as in the Gilbert multiplier cell.

The Gilbert multiplier cell can be linearized by using a Gilbert gain cell, which is a well-known linearizing circuit, as an input circuit. Originally, a resultant circuit thus obtained is generally called a Gilbert multiplier.

In analog signal processing operations, the multiplier is an essential functional block. As the fabrication process becomes finer, a supply voltage for an LSI is reduced down to a level between 5 (V) and 3 (V) or a lower level. A demand for a circuit operable at a low supply voltage is more and more increasing. Although the conventional multiplier is operable at a low supply voltage, an input voltage range is similar to that of the Gilbert multiplier cell and is very narrow as a linear input voltage range.

Figure 2:
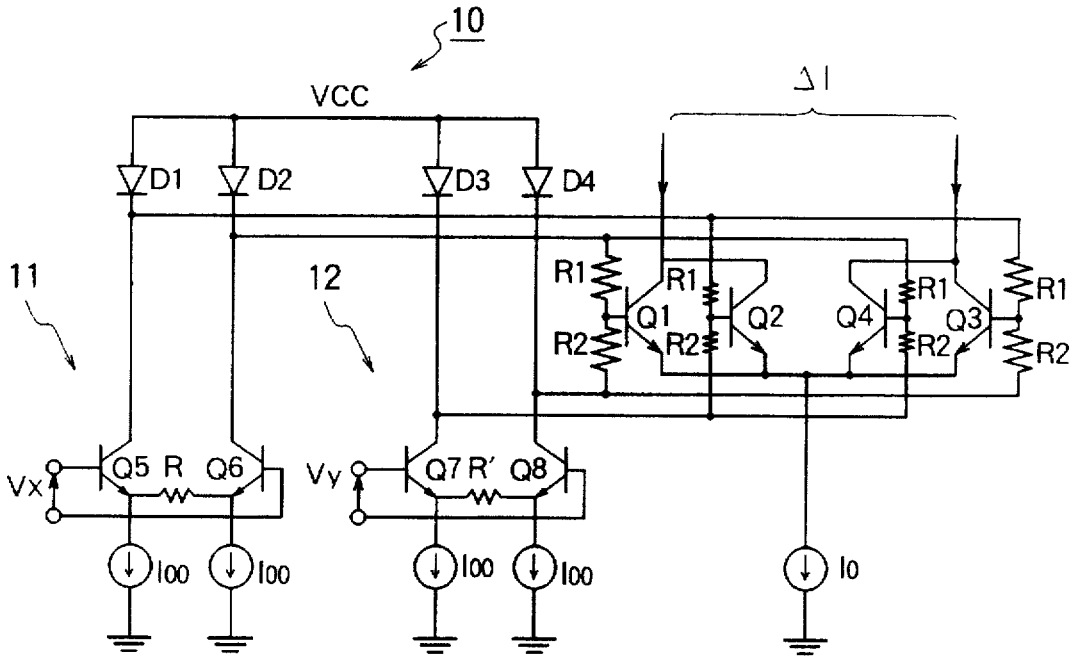
FIG. 2 shows a circuit diagram of a bipolar multiplier according to a first embodiment of this invention.

Referring to FIG. 2, the description will proceed to a bipolar multiplier according to a first embodiment of this invention. The bipolar multiplier comprises the quadritail cell illustrated in FIG. 1 and an inverse hyperbolic tangent conversion circuit 10 as an input circuit for the quadritail cell. The inverse hyperbolic tangent conversion circuit 10 comprises first and second differential amplifiers 11 and 12. The first differential amplifier 11 is supplied with a first input signal having a first input voltage Vx and comprises fifth and sixth transistors Q5 and Q6 which are driven by a common tail current $I_{OO}$. Similarly, the second differential amplifier 12 is supplied with a second input signal having a second input voltage Vy and comprises seventh and eighth transistors Q7 and Q8 which are driven by the common tail current $I_{OO}$. First through fourth diodes D1 to D4 are connected to collector terminals of the fifth through eighth transistors Q5 to Q8 as a load.

Each of base terminals of the first through the fourth transistors Q1 to Q4 is connected to the inverse hyperbolic tangent conversion circuit 10 through a resistor pair which comprises first and second resistors R1 and R2.

In such a circuit arrangement, each of the transistors Q1 to Q4 is individually supplied through the resistor pair with a combination of one of positive and negative phase outputs of the first differential amplifier 11 and one of positive and negative phase outputs of the second differential amplifier 12. It should be noted here that the combination is different to that supplied to any other transistor.

Figure 3:
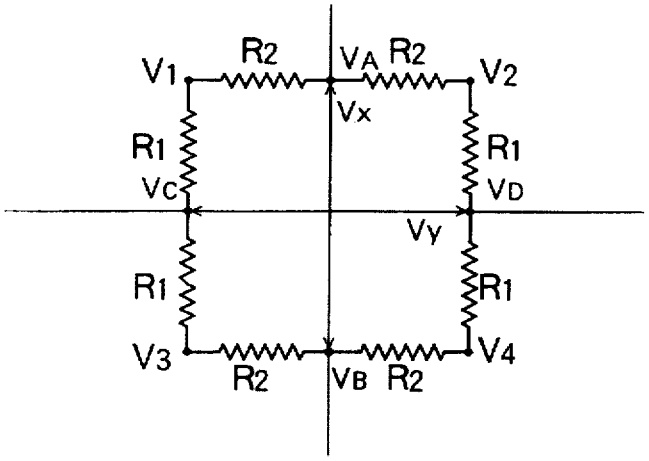
FIG. 3 shows an equivalent circuit diagram for describing input voltages supplied to a quadritail cell illustrated in FIG. 2.

As described in conjunction with FIG. 1, the quadritail cell itself has a transfer characteristic similar and substantially equal to that of the Gilbert multiplier cell. The first and the second input signals are subjected by the differential amplifiers 11 and 12 to inverse hyperbolic tangent conversion ($\tanh^{-1}(x)$). Thus, a hyperbolic tangent function characteristic (tanh(x)) is cancelled and linearization is achieved for both of the first and the second input voltages Vx and Vy. Referring to FIG. 3, it is assumed here that input voltages ($V_1$, $V_2$, $V_3$, and $V_4$) supplied to the quadritail cell are given by ($aV_C+bV_A$, $aV_D+bV_A$, $aV_C+bV_B$, $aV_D+bV_B$), respectively, where a and b are given constants. In this event, collector currents $I_{C1}$ to $I_{C4}$ of the first through the fourth transistors Q1 to Q4 are represented by:

$$I_{C1} = I_S \exp\left(\frac{aV_C + bV_A + V_R - V_E}{V_T}\right), \quad (11)$$

$$I_{C2} = I_S \exp\left(\frac{aV_D + bV_A + V_R - V_E}{V_T}\right), \quad (12)$$

$$I_{C3} = I_S \exp\left(\frac{aV_C + bV_B + V_R - V_E}{V_T}\right), \quad (13)$$

and $$I_{C4} = I_S \exp\left(\frac{aV_D + bV_B + V_R - V_E}{V_T}\right), \quad (14)$$

where $V_A-V_B=Vx$ and $V_C-V_D=Vy$. From the condition for the tail current, the following equation holds:

$$I_{C1}+I_{C2}+I_{C3}+I_{C4}=\alpha_F I_O. \quad (15)$$

Solving Equation (15) with Equations (11) through (14), a differential output current ΔI of the bipolar multiplier is given by:

$$\Delta I = \alpha_F I_0 \tanh\left(\frac{aVx}{2V_T}\right) \tanh\left(\frac{bVy}{2V_T}\right). \quad (16)$$

Thus, linearization is achieved once the input voltages aVx and bVy have been subjected to the inverse hyperbolic tangent conversion ($\tanh^{-1}(x)$). Since the input circuit for the quadritail cell comprises the two differential amplifiers 11 and 12 having the diodes D1 to D4 as the load and exhibiting output characteristics of a ratio represented by b:a, the first and the second input signals are subjected to the inverse hyperbolic tangent conversion ($\tanh^{-1}(x)$). As a result, the hyperbolic tangent function characteristic (tanh(x)) is cancelled.

Thus, the linearization is achieved for both of the two input voltages Vx and Vy. Specifically, calculation is made of the products of voltage drop values at resistors R and R' interposed between emitters by the use of a resistance value and a constant current supply value in each of the two differential amplifiers 11 and 12. To achieve linearization, the ratio of the products must be equal to a:b. The constants a and b are given by $a=R_1/(R_1+R_2)$ and $b=R_2/(R_1+R_2)$.

From the foregoing description, it is understood that, when the first and the second input signals are subjected to the inverse hyperbolic tangent conversion ($\tanh^{-1}(x)$) by the use of the two differential amplifiers 11 and 12, the hyperbolic tangent function characteristic (tanh(x)) is cancelled and the linearization is achieved for both of the two input voltages Vx and Vy.

In addition, the constants a and b may be arbitrarily selected. When a=b=½, the circuit is simplest. In this event, the two differential amplifiers 11 and 12 can be identical and the two resistors R1 and R2 forming the resistor pair connected to each base input of the quadritail cell are allowed to have the same resistance.

Figure 4:
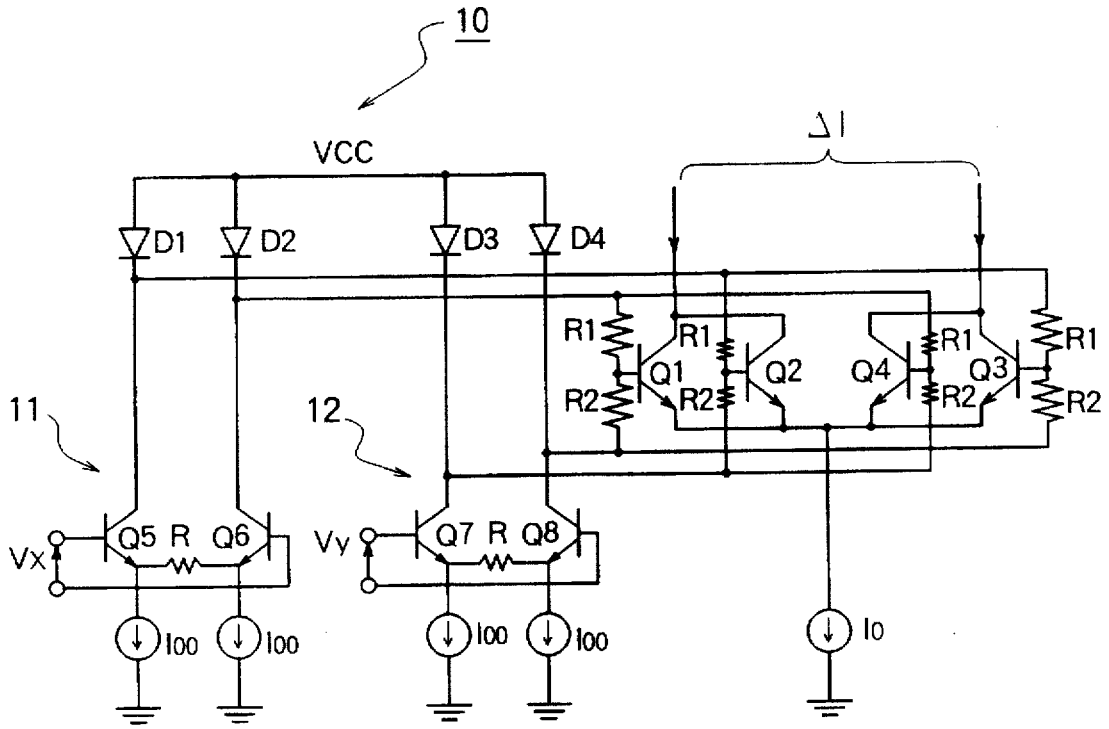
FIG. 4 shows a circuit diagram of a bipolar multiplier according to a second embodiment of this invention.

Referring to FIG. 4, a bipolar multiplier is similar to that illustrated in FIG. 2 except that both of the first and the second differential amplifiers 11 and 12 comprises the resistor R. For linearization within the input voltage range on the order of 1 (V) in this circuit, the product of the voltage drop value at the resistor R interposed between the emitters, namely, the emitter degeneration value, specifically, the resistance value and the constant current supply value in each of the above-mentioned differential amplifiers must be on the order of 1 (V). The output voltages of the differential pairs are subjected to logarithmic compression by the diodes D1 to D4. Accordingly, the input voltages supplied to the quadritail cell are not greater than 100 (mV). Unlike the Gilbert multiplier cell, the transistors are not laid in series. Therefore, operation is possible at a low supply voltage. Specifically, the supply voltage for the circuit on the order of 2 (V) is sufficient.

As described above, according to this invention, the bipolar multiplier is achieved which is excellent in linearity, wide in input voltage range, and operable at a supply voltage as low as 2 (V).

What is claimed is:

1. A bipolar multiplier for multiplying a first input signal and second input signal, said bipolar multiplier comprising a quadritail cell including two transistor pairs driven by a common tail current and composed of first through fourth transistors whose outputs are connected in common to form differential output pairs, said bipolar multiplier having a differential output characterized as a hyperbolic tangent function of said first input signal and said second input signal, and said bipolar multiplier further comprising:

a conversion circuit connected to an input side of said quadritail cell for carrying out inverse hyperbolic tangent conversion of said first input signal and said second input signal, said conversion circuit composed of first and second differential amplifiers which are supplied with said first and said second input signals, respectively.

2. A bipolar multiplier as recited in claim 1, wherein each of said first through said fourth transistors is individually supplied through a resistor pair with a combination of one of positive and negative phase outputs of said first differential amplifier and one of positive and negative phase outputs of said second differential amplifier, such that a different combination is applied to each of said first through said fourth transistors.

3. A bipolar multiplier as recited in claim 1, wherein said first differential amplifier and said second differential amplifier each comprise two transistors.

4. A bipolar multiplier as recited in claim 3, wherein said conversion circuit further comprises first through fourth diodes and each of said first through fourth diodes is connected to one of said transistors of one of said first differential amplifier and said second differential amplifier.

5. A bipolar multiplier as recited in claim 3, wherein a first differential amplifier resistor is interposed between emitters of said transistors of said first differential amplifier and a second differential amplifier resistor is interposed between emitters of said transistors of said second differential amplifier.

6. A bipolar multiplier as recited in claim 5, wherein said first differential amplifier resistor and said second differential amplifier resistor have an equal resistance.

* * * * *